United States Patent [19]

Nasu

[11] Patent Number: 5,018,418

[45] Date of Patent: May 28, 1991

[54] APPARATUS FOR CUTTING LAMINATED SHEET MATERIAL

[75] Inventor: Nobuo Nasu, Fukuyama, Japan

[73] Assignee: Kabushiki Kaisha Kawakami Seisakusho, Hiroshima, Japan

[21] Appl. No.: 574,508

[22] Filed: Aug. 28, 1990

Related U.S. Application Data

[60] Continuation of Ser. No. 446,641, Dec. 6, 1989, abandoned, which is a division of Ser. No. 354,510, May 19, 1988, Pat. No. 4,916,992.

[30] Foreign Application Priority Data

May 31, 1988 [JP] Japan ..... 63-131389

[51] Int. Cl.[5] ..... B26D 1/06

[52] U.S. Cl. ..... 83/177; 83/271; 83/451; 83/781; 83/940; 83/953; 198/343.1

[58] Field of Search ..... 83/936, 938, 939, 451, 83/152, 402, 169, 353, 424, 427, 428, 433, 647, 318, 319, 320, 435.2, 271, 781, 953; 198/343; 72/426

[56] References Cited

U.S. PATENT DOCUMENTS

| | | | |
|---|---|---|---|
| 3,511,124 | 5/1970 | Bruns | 83/427 X |
| 3,589,222 | 6/1971 | Sederberg | 83/424 X |
| 3,797,341 | 3/1974 | Bystron | 83/451 X |
| 4,007,655 | 2/1977 | Schuetz et al. | 83/155 |
| 4,831,809 | 5/1989 | Bullestrazzi | 198/343 X |

*Primary Examiner*—Frank T. Yost

*Assistant Examiner*—Kenneth E. Peterson

*Attorney, Agent, or Firm*—Ladas & Parry

[57] ABSTRACT

A laminate cutting apparatus has a support belt supported on a frame for reciprocating horizontally in the longitudinal direction, independently lowerable support plates juxtaposed in the longitudinal direction and retained on the frame for supporting the bottom of a laminate support portion of the belt, suction ports on opposing side portions of the frame for withdrawing air from the interior of the laminate supported on the support portion with its upper and lower surfaces covered with air-impermeable sheets, a longitudinally reciprocated travelling body supported on the frame, a transversely reciprocated cutter head supported on the travelling body, a cutter on the cutter head for being raised and lowered to cut the laminate, recess forming rollers for forming the support portion of the belt into a transversely extending movable recess open at the top, a lower receiving member secured to the travelling body and arranged in parallel with the rollers within the recess, interconnected closure plates within the receiving member for reciprocating transversely in synchronization with the cutter head, a cutter receiving sleeve between closure plates for supporting the cutter tip, and cam plates on the travelling body for lowering the support plates to a level below the recess. Upper surfaces of the support portion of the belt, the lower receiving member, the closure plates, and the sleeve are substantially flush.

6 Claims, 8 Drawing Sheets

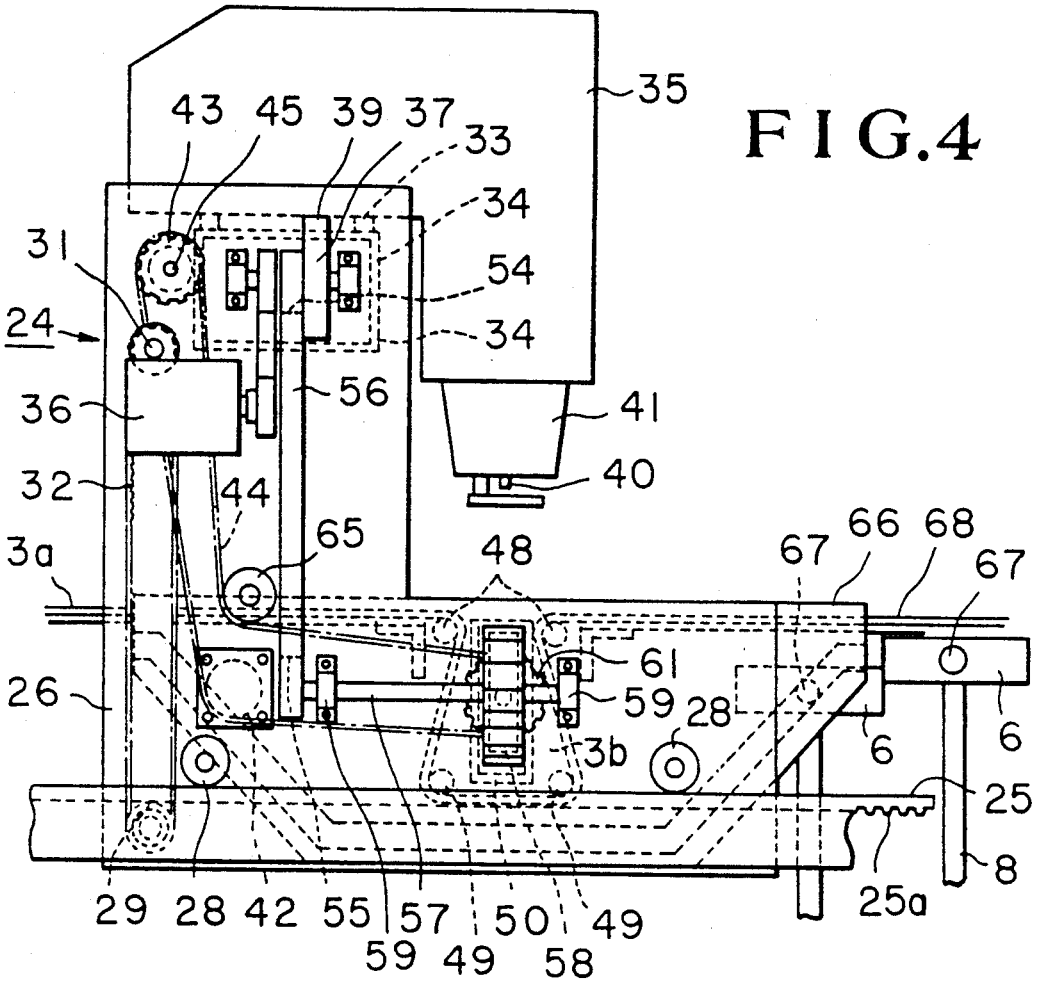
FIG.4
FIG.5
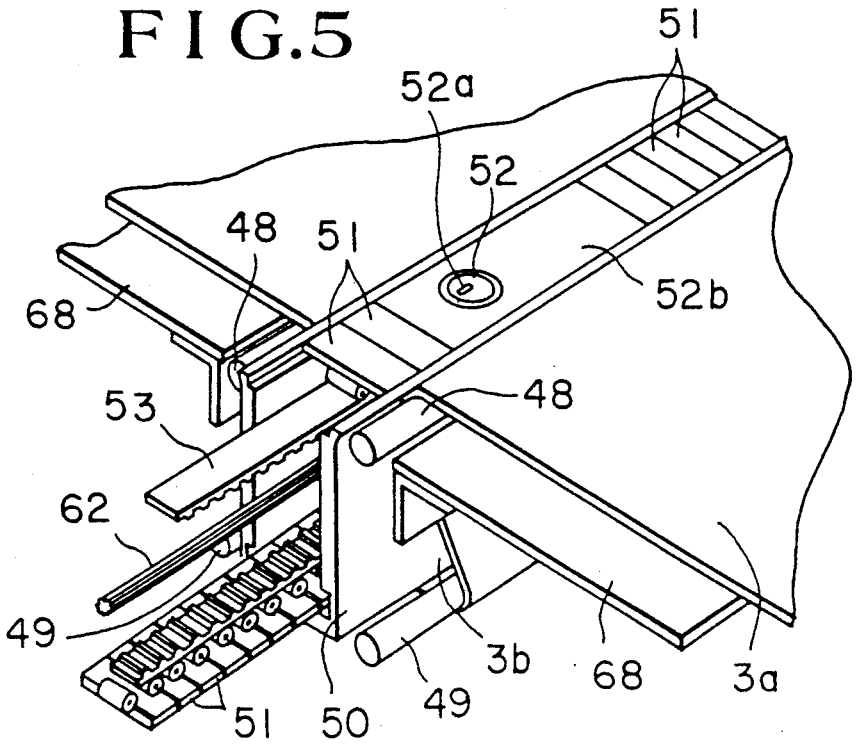

APPARATUS FOR CUTTING LAMINATED SHEET MATERIAL

This is a continuation of co-pending application Ser. No. 07/446,641 filed Dec. 6, 1989, which is a divisional of application Ser. No. 07/354,510 filed May 19, 1988, now U.S. Pat. No. 4,916,992, granted on Apr. 17, 1990.

BACKGROUND OF THE INVENTION

This invention relates to an apparatus for cutting a sheet material such as cloth in the form of a laminate consisting of a number of sheets which are sewed.

An example of a conventional cutting apparatus of this type is as disclosed in the specification of Japanese Patent Publication (KOKOKU) No. 51-12120. The apparatus includes a frame the upper portion of which is provided with an air-permeable bed, and a pressure-reducing chamber provided below the bed. The laminated sheets are placed on the bed and the upper surface thereof is covered with an air-impermeable sheet. A travelling body supported on the frame is reciprocated in the longitudinal direction, a cutter head supported on the travelling body is reciprocated in the transverse direction, and a cutter mounted on the cutter head so as to be movable vertically is turned about a vertical axis. Thus, the laminated sheets may be cut to a desired shape by the cutter.

Another example of such a cutting apparatus is disclosed in the specification of Japanese Patent Publication (KOKOKU) No. 51-19193. This apparatus includes a bottom member interposed between a bed and laminated sheets of a material, a guide member provided on the bottom member, a cutter fitted to the lower end portion of the guide member, and a cutter head. The bottom member is moved longitudinally and transversely in conformity with associated operation of the cutter head, and the guide member is turned in accordance with turning of the cutter.

A number of problems are encountered in these prior-art apparatus. Specifically, in the apparatus disclosed in the specification of Japanese Patent Publication (KOKOKU) No. 51-12120, a cantilever-type configuration is used in the arrangement having the cutter mounted on the cutter head. Consequently, the cutter flexes at cutting owing to resistance offered by the laminated sheet material and bed, as a result of which the laminated sheets cannot be cut in a highly precise manner. With the cutting apparatus disclosed in the specification of Japanese Patent Publication (KOKOKU) No. 51-19193, the cut portion of the laminated sheet material as well as the vicinity thereof is caused to bulge upwardly by the bottom portion. This makes it impossible to cut the laminated sheets with high precision even though the lower end of the cutter is supported by the guide member. In addition, a difference develops between the positions at which the upper layers and lower layers of the laminate are cut; the thicker the laminate, the greater this difference becomes.

SUMMARY OF THE INVENTION

Accordingly, a first object of the present invention is to provide an apparatus for cutting a laminated sheet material in which even a thick laminated sheet material can be cut by a cutter with high precision.

A second object of the present invention is to provide an apparatus for cutting a laminated sheet material in which laminated sheets can be cut by a superhigh pressure liquid with high precision through a comparatively simple arrangement.

According to the present invention, the first object is attained by providing an apparatus for cutting a laminate of sheet material upper and lower surfaces of which are covered with an air-impermeable sheet, comprising: a frame; a support belt supported on the frame for reciprocating horizontally in a longitudinal direction of the frame and having a support portion for supporting the laminate of sheet material; a number of support plates arranged side by side in the longitudinal direction of the frame and retained thereon so as to be lowerable independently of one another, the support plates supporting a lower surface of the support portion of the support belt; suction port members disposed on opposing side portions of the frame and extending in the longitudinal direction for applying suction to side faces of the laminate of sheet material supported on the support portion of the support belt and having its upper and lower surfaces covered with the air-impermeable sheet; a travelling body supported on the frame for reciprocating in the longitudinal direction; a cutter head supported on an upper portion of the travelling body for reciprocating in a transverse direction; a downwardly extending cutter mounted on the cutter head for being raised and lowered so as to penetrate the laminate of sheet material, the cutter being turnable about a vertical axis; recess forming rollers arranged in opposed relation below the cutter head of the travelling body and extending in the transverse direction for forming the support portion of the support belt into a transversely extending movable recess having an upper surface which is open; a lower receiving member secured to the travelling body and arranged in parallel with the recess forming rollers within the movable recess, the lower receiving member having a groove-shaped cross section; a number of interconnected closure plates accommodated within the receiving member for reciprocating in the transverse direction in synchronization with the cutter head; a cutter receiving sleeve fitted between closure plates so as to be capable of supporting a tip of the cutter, the cutter receiving sleeve being turnable about a vertical axis in synchronization with the cutter; and a cam plate provided on the travelling body for lowering the support plates to a level below the movable recess of the support belt; upper surfaces of the support portion of the support belt, the lower receiving member, the closure plates, and the cutter receiving sleeve being made substantially flush with an identical horizontal plane.

According to the present invention, the second object is attained by providing an apparatus for cutting a laminate of sheet material upper and lower surfaces of which are covered with an air-impermeable sheet, comprising: a frame; a support belt supported on the frame for reciprocating horizontally in a longitudinal direction of the frame and having a support portion for supporting the laminate of sheet material; a number of support plates arranged side by side in the longitudinal direction of the frame and retained thereon so as to be lowerable independently of one another, the support plates supporting a lower surface of the support portion of the support belt; a travelling body supported on the frame for reciprocating in the longitudinal direction; a nozzle head supported on the travelling body for reciprocating in a transverse direction; a nozzle mounted on the nozzle head for jetting, in a linear stream, a superhigh pressure liquid for penetrating and cutting the laminate of sheet material; recess forming rollers arranged in opposed relation below the cutter head of the travelling body and extending in the transverse direction for forming the support portion of the support belt into a transversely extending movable recess having an upper surface which is open; a lower receiving member secured to the travelling body and arranged in parallel with the recess forming rollers within the movable recess, the lower receiving member having a groove-shaped cross section; a number of interconnected closure plates accommodated within the receiving member for reciprocating in the transverse direction in synchronization with the cutter head; a liquid receiving sleeve fitted between closure plates for allowing the liquid jetted from the nozzle to pass therethrough; a liquid discharge passageway for discharging the liquid, which is jetted from the nozzle, to a suitable location via the liquid receiving sleeve and the lower receiving member; and a cam plate provided on the travelling body for lowering the support plates to a level below the movable recess of the support belt; upper surfaces of the support portion of the support belt, the closure plates and the liquid receiving sleeve being made substantially flush with an identical horizontal plane.

Thus, in accordance with the first aspect of the invention, the longitudinally extending suction port members are arranged on the frame along both sides thereof, a number of the lowerable support plates are held by the frame in side-by-side relation in the longitudinal direction, and the portion of the support belt which supports the laminated sheet material is supported on the support plates, whereby the laminated sheet material, the upper and lower surfaces whereof are covered with the air-impermeable sheet, is supported on the support portion of the belt. When suction is applied to the two side surfaces of the laminate by the suction port members, mutually adjacent sheets of the laminate are drawn into intimate contact with each other to reduce the overall thickness of the laminate in comparison with an arrangement in which suction is applied to the lower surface of the laminate. The laminate is cut while in this state of reduced thickness. The upper end portion of the cutter is mounted on the cutter head, the lower end portion of the cutter is supported by the cutter receiving sleeve, and the upper surfaces of the receiving sleeve, the closure plates between which the sleeve is fitted, and the lower receiving member are arranged on a horizontal plane substantially level with the support surface of the support belt. As a result, the laminate remains substantially flat without bends or curves at the portion thereof cut by the cutter.

In accordance with the second aspect of the invention, the linear stream of the superhigh pressure liquid jetted by the nozzle cuts the laminate while the laminate is in the state of reduced thickness, achieved by the means described above. The upper surfaces of the liquid receiving sleeve through which the jetted liquid passes, the closure plates between which the sleeve is fitted, and the lower receiving member accommodating these are arranged on a horizontal plane substantially level with the support surface of the support belt. As a result, the laminate remains substantially flat without bends or curves at the portion thereof cut by the jetted liquid. Furthermore, since the arrangement is such that cutting is performed by the non-directional stream of superhigh pressure liquid, there is need for a mechanism for turning the nozzle and liquid receiving sleeve synchronously about a vertical axis, unlike the arrangement using the cutter which does require a mechanism for turnign cutter and its receiving sleeve.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 4 is an explanatory enlarged side view of a travelling body of the apparatus;

FIG. 5 is an enlarged perspective view of a portion mounting a cutter receiving sleeve of the apparatus;

DESCRIPTION OF THE PREFERRED EMBODIMENT

An embodiment of the invention will now be described with reference to FIGS. 1 through 5.

Figure 1:
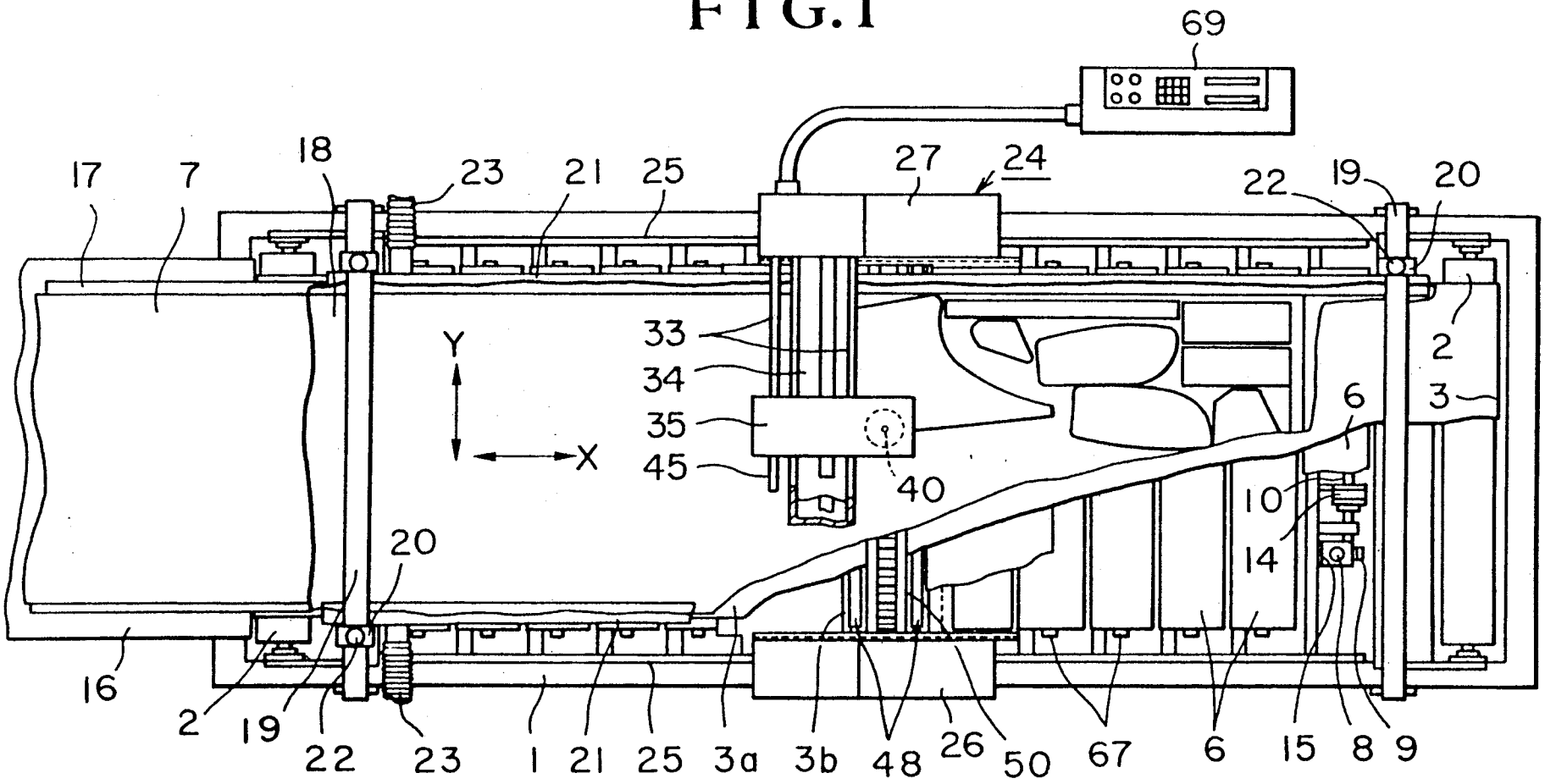
FIG. 1 is a plan view, partially cut away, illustrating an embodiment of a laminated sheet material cutting apparatus according to the present invention.
Figure 2:
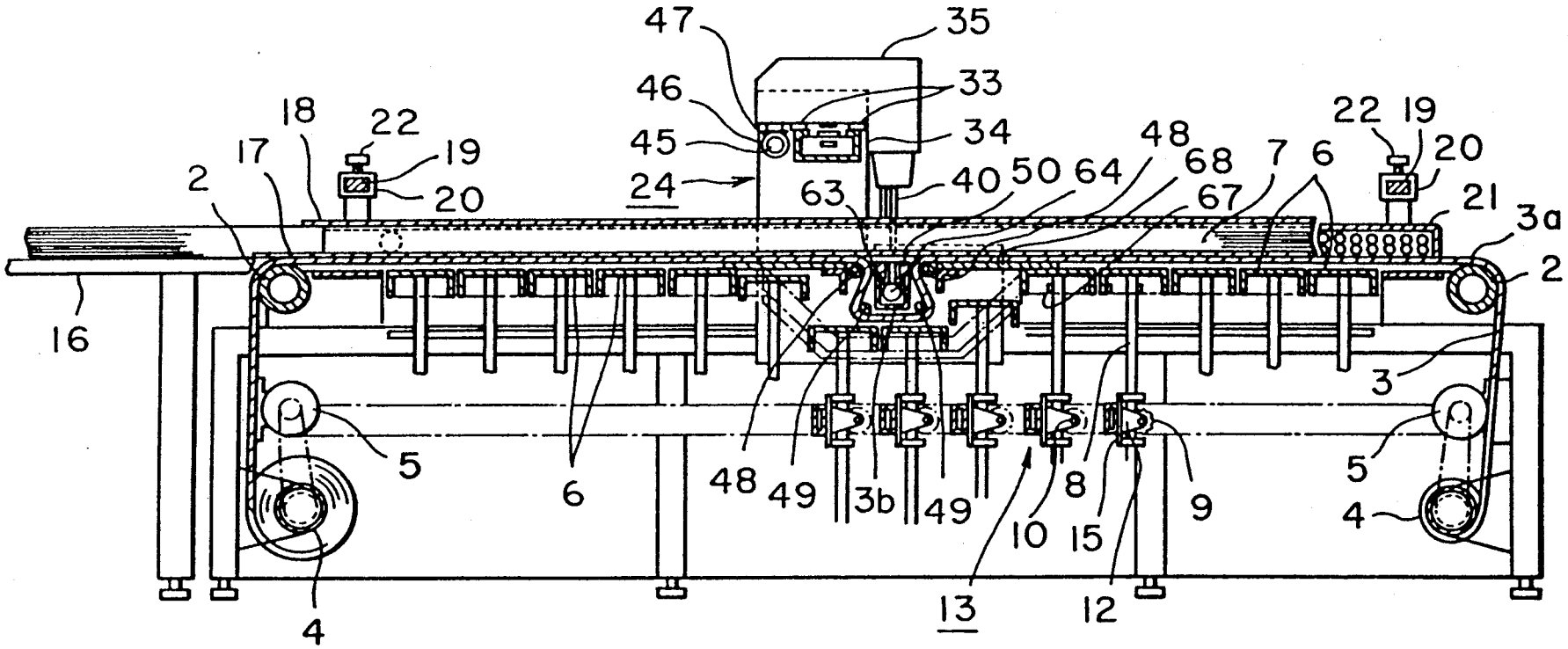
FIG. 2 is a longitudinal sectional view of the apparatus.
Figure 3:
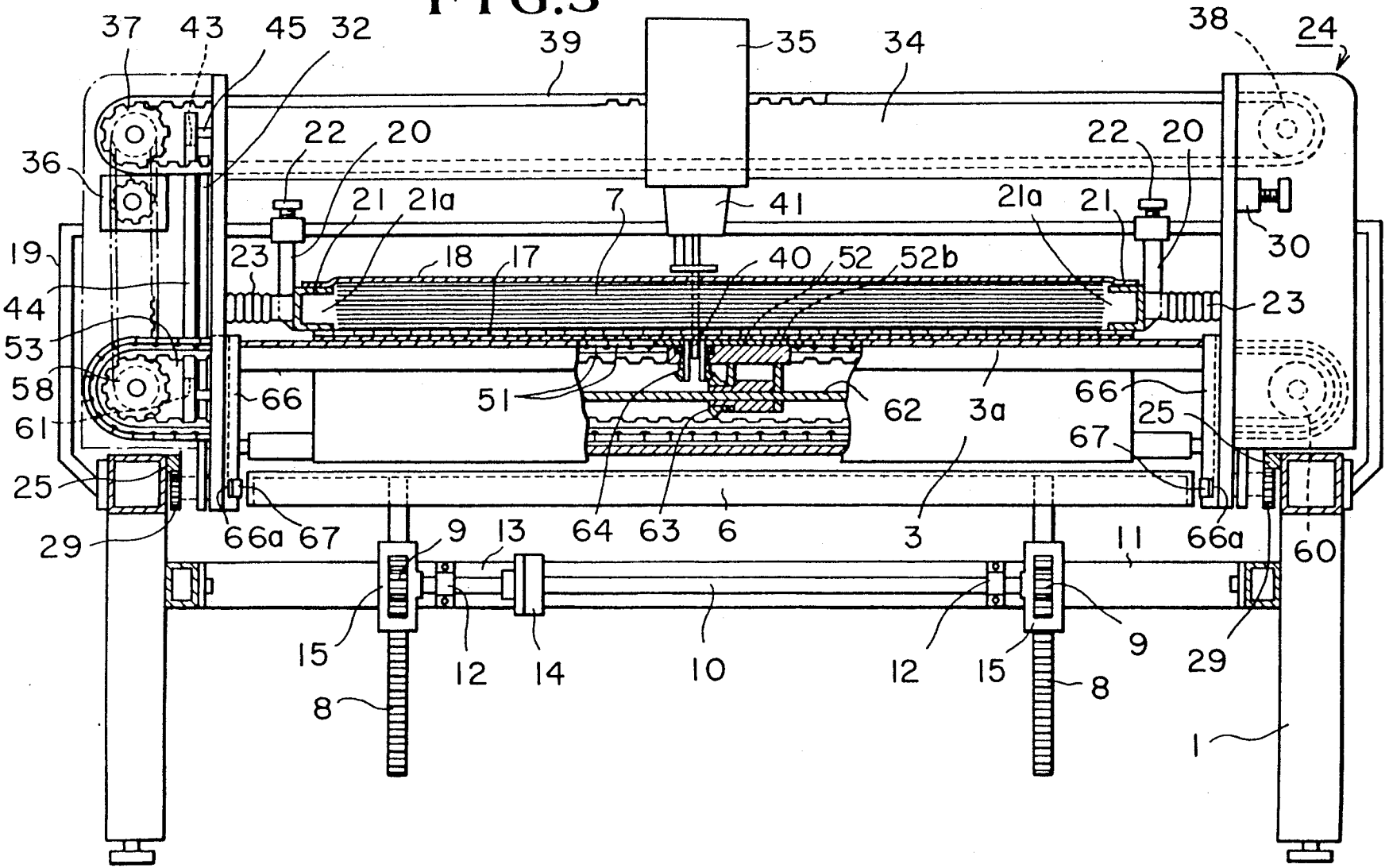
FIG. 3 is a transverse sectional view of the apparatus.

With reference to FIGS. 1 through 3, there is shown a rectangular frame 1 whose length in the longitudinal (X) direction is greater than that in the transverse (Y) direction. Front and rear ends of the frame 1 are provided with transversely extending front and rear support rollers 2 horizontally supported for free rotation via bearings. These front and rear support rollers 2 support a support belt 3 having a support portion 3*a* for supporting a laminate of sheet material. The end portions of the support belt 3 depend from the front and rear support rollers 2 and are connected to take-up rollers 4 freely pivotally supported to the front and rear ends of the frame 1 from therebelow. Belt driving motors 5 are provided on the front and rear ends of the frame 1. The arrangement is such that support belt 3 can be wound up on either of the take-up rollers 4 by operating the motors 5.

The frame 1 holds a number of transversely extending support plates 6 each having a cross section defining an upright groove. The support plates 6 are arranged side by side in the longitudinal direction in close contact with one another, in which state they are retained by the frame 1 so as to be capable of being raised and lowered, as will be described later. The lower surface of the support portion 3*a* of support belt 3 situated between the support rollers 2 is supported by these support plates 6.

A mechanism 13 is provided for raising and lowering the support plates 6. The mechanism 13 includes rack bars 8, each of which has a circular cross section, provided at two locations transversely of the support plates 6 and extending downardly from the lower surfaces thereof. Pinions 9 mesh with the rack bars 8 and are secured to both end portions of a connecting shaft 10, which is supported horizontally and rotatably by bearings 12 on a support plate retaining member 11 fixed to the frame 1. An electrically controlled brake 14 is attached to the connecting shaft 10 and utilizes electricity, air or hydraulic pressure. The brake 14 is operated at a prescribed time to release the shaft 10, but ordinarily locks the connecting shaft 10 to the retaining member 11 so as to maintain the supporting plate 6 in the elevated state. Secured to the retaining member 11 are vibrating preventing members 15 for slidably supporting the rack bars 8. The mechanism 13 is provided for each of the support plates 6 and each mechanism operates independently of the others.

The rear end of a spreading table 16 is disposed forwardly of the front end of the frame 1 near the support portion 3*a* of support belt 3, and the upper surface of the support portion 3*a* and that of the spreading table 16 are arranged to lie on the same horizontal plane. The arrangement is such that a laminate 7 spread on an air-impermeable sheet 17 and having its upper surface covered with an air-impermeable sheet 18 is guided onto the support portion 3*a* from the table 16.

Both ends of a mounting member 19 having a generally inverted U-shaped configuration are fixed to front and rear end portions of the frame 1. The mounting member 19 is arranged so as to span from above the sheet material laminate 7 supported on the support portion 3*a* and having its upper and lower surfaces covered with the air-impermeable sheets 17, 18. Hanging members 20 are fitted to and supported from the upper portion of the mounting member 19 so as to be slidable in the transverse direction. The front and rear end portions of suction port members 21 are secured to the hanging members 20. The suction port members 21 are arranged in parallel on both sides of the frame 1 and extend in the longitudinal direction. The suction port members 21 have suction ports 21*a* formed over the entire length of their longitudinal opposing side faces. By moving the hanging members 20 transversely with respect to the mounting member 19, the suction port members 21 can be positionally adjusted in the transverse direction in such a manner that their suction ports 21*a* are made to approach both side faces of the laminate 7 and oppose the same. The suction port members 21 are fixed at their adjusted positions by tightening setscrews 22 threaded into the hanging members 20. The suction port members 21 are formed having a square cross section or the like in which the suction ports 21*a* oppose one another, the front and rear end faces thereof being closed by end plates, and each being connected to a suction device (not shown), such as a vacuum pump, via a suction duct 23 connected to the back face of the member.

As shown in FIGS. 1 through 4, a travelling body 24 is supported on the frame 1 so as to be capable of reciprocating in the longitudinal direction. The travelling body 24 has left and right frame members 26, 27 the upper end portions of which are secured at a connecting beam 34. More specifically, rack rails 25 are secured to both sides of the frame 1 at the upper part thereof and extend horizontally in the longitudinal direction, front and rear wheels 28 axially supported on the frame members 26, 27 of the travelling body 24 are supported on the rack rails 25 so as to roll freely, and traveling gears 29 axially supported on the frame members 26, 27 mesh with racks 25*a* formed on the lower surfaces of the rack rails 25. A reversible motor 30 is provided in the frame member 27 and transmits driving force to the left and right travelling gears 29 via a connecting shaft 31 and a connecting belt 32 for travel, etc. As a result, the travelling body 24 is reciprocated longitudinally while being guided along the rack rails 25.

The connecting beam 34 of the travelling body 24 is provided with rails 33 on which a cutter head 35 is supported so as to be capable of being reciprocated in the transverse direction. A reversible rotating head and a motor 36 for driving a receiving sleeve are provided in one frame member 26 of the travelling body 24. The motor 36 transmits driving force to a head driving pulley 37 provided in the upper portion of the frame member 26. Stretched between this driving pulley 37 and a driven pulley 38 provided in the upper portion of the other frame member 27 is a head driving belt 39 comprising an endless timing belt. The belt 39 is disposed in the connecting beam 34. Driving force from the driving pulley 37 is transmitted to the head driving belt 39, whereby the cutter head 35 is reciprocated transversely above the laminate 7 of sheet material. Provided within the cutter head 35 are a reversible motor (not shown) for raising and lowering the cutter, as well as a raising and lowering member (not shown) raised and lowered by this motor. A knife-edged cutter 40 is detachably mounted on the raising and lowering member so as to be rotatable about a vertical axis. A cutter guide 41, which is supported on the lower portion of the cutter head 35 so as to be rotatable in the same direction as the cutter 40, is engaged with the cutter 40. Provided within the frame member 26 of the travelling body 24 at the lower portion thereof is a reversible motor 42 for rotating the cutter and a receiving sleeve. Driving force is transmitted from the motor 42 to an upper spline shaft drive pulley 43, which is provided within the frame member 26 at the upper portion thereof, via a synchronizing belt 44 which is a timing belt. Driving force is transmitted from the upper spline shaft drive pulley 43 to the cutter guide 41 via an upper spline shaft 45 having the pulley 43 fixedly fitted onto one end thereof and being axially supported on the frame members 26, 27 in parallel with the connecting beam 34, a bevel gear 46 (FIG. 2) slidably engaged with the spline shaft 45, and a bevel gear 47 meshing with the bevel gear 46 and axially supported on the cutter head 35 so as to be rotatable. Owing to transmission of the driving force, the cutter 40 extending downwardly from the cutter head 35 rotates about a vertical axis through an angular range of 360°. It should be noted that the mechanism for reciprocating the cutter head 35, raising and lowering the cutter 40 and rotating the same is similar to that described in the specification and drawings of Japanese Patent Application No. 62-100955 previously filed by the applicant.

Four recess forming rollers 48, 49 are arranged below the cutter head 35 between the left and right frame members 26, 27 of the travelling body 24, and both ends of these rollers 48, 49 are axially supported for free rotation on the frame members 26, 27. The support belt 3 is supported on the two upper recess forming rollers 48 from above rollers 48 and is supported on the two recess forming rollers 49 underlying recess forming rollers 48 from below the rollers 49. These four rollers 48, 49 form the support portion 3*a* of the support belt 3 into a movable recess 3b extending across the entire transverse width of the belt.

Figure 6:
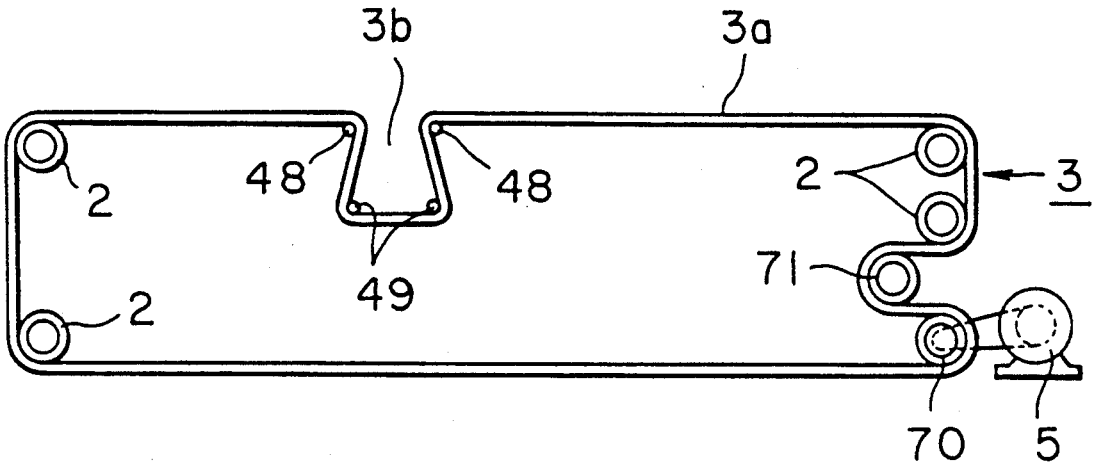
FIG. 6 is a side view illustrating a modification of a support belt of the apparatus.

The reader may wish to refer at this point to FIG. 6, which, although it shows a modified bolt structure, it will allow the reader to more quickly appreciate the path taken by belt 3 in the vicinity of rollers 48,49.

The upper side of the recess 3b is open, with the longitudinal dimension of the recess being gradually larger from the upper to the lower side thereof.

As can be best seen in FIG. 5, a lower receiving member 50 having a generally groove-shaped transverse cross section is secured between the frame members 26, 27 of the travelling body 24 and is disposed in the movable recess 3b with some clearance between itself and the support belt 3.

As shown also in FIG. 5, a number of interconnected closure plates 51 are slidably disposed within the lower receiving member 50, a retaining plate 52b is interposed between the closure plates 51, and a cutter receiving sleeve 52 is retained on the retaining plate 52b so as to be freely rotatable about a vertical axis. Thus an endless receiving portion is formed in which the upper surfaces of these members are situated on a common plane. The receiving portion is disposed below the cutter head 35 with both its ends projecting from both ends of the lower receiving member 50. The cutter receiving sleeve 52 is provided with a support hole 52a into which the lower end portion of the cutter 40 is inserted.

A synchronous drive pulley 54 (FIG. 4) is secured coaxially with the head drive pulley 37 driven by drive motor 36. A receiving portion connecting belt 56 is stretched between the pulley 54 and a lower driven pulley 55. A receiving portion drive pulley 58 is fixed to a connecting shaft 57 to which the lower driven pulley 55 is secured, and a receiving portion drive belt 53 (FIG. 3), which is a timing belt, is stretched between the receiving portion drive pulley 58 and a receiving portion driven pulley 60 disposed within the frame member 27. The connecting shaft 57 is rotatably supported on the frame member 26 by bearings 59. Owing to drive of the head and receiving portion drive motor 36, the cutter receiving sleeve 52 is reciprocated in synchronization with the transverse reciprocating movement of the cutter head 35, and in the same direction, via the cutter head drive pulley 37, etc. In other words, the synchronous drive pulley 54 is driven in synchronization with the cutter head drive pulley 37, the receiving portion drive pulley 58 is turned via the receiving portion connecting belt 56, the lower driven pulley 55 and the connecting shaft 57, and the closure plates 51 and cutter receiving sleeve 52 constructing the receiving portion are reciprocated transversely together with the receiving portion drive belt 53 by the receiving portion drive pulley 58.

Driving force is transmitted from the cutter and receiving sleeve drive motor 42 to a lower spline shaft drive pulley 61 (--; which, as can be seen in FIG. 4, is provided in the side frame 26 at the lower portion thereof--) via the synchronizing belt 44. Driving force is transmitted from the lower spling shaft drive pulley 61 to the cutter receiving sleeve 52 via a lower spline shaft 62 (FIG. 3) having the pulley 61 fixedly fitted onto one end thereof, the spline shaft 62 being accommodated within the lower receiving member 50 in parallel therewith and axially supported on the frame members 26, 27. A bevel gear 63 is slidably engaged on the spline shaft 62, and a bevel gear 64 meshes with the bevel gear 63 and is disposed on the lower portion of the cutter receiving sleeve 52. The cutter receiving sleeve 52 is thus rotated about a vertical axis. Furthermore, a tension pulley 65, attached to the side member 26, is urged against the synchronizing belt 44.

Cam plates 66 are used to lower the support plates 6 in the vicinity of the movable recess and thus are fixed to respective ones of the frame members 26, 27 at the lower portions thereof. The opposing faces of the cam plates 66 are each provided with a cam groove 66a having a low, horizontal central portion in the longitudinal direction underlying the movable recess 3b of the support belt 3, the groove being slanted upwardly towards both end portions in the longitudinal direction. A cam roller 67 capable of engaging with and disengaging from the cam groove 66a is rotatably supported at both ends of each support plate 6. An auxiliary support plate 68 (FIG. 5) which projects slightly from the end of the cam plate 66 is arranged on each side of the overlying recess forming rollers 48 in the longitudinal direction. The auxiliary support plates 68 are secured to the frame members 26, 27 and freely slidably support the lower surface of the laminate support portion 3a substantially corresponding to the portions of the cam plates 66 that project from the movable recess 3b of the support belt 3.

The laminate support portion 3a of the support belt 3, the lower receiving portion 50, the closure plates 51 and the cutter receiving sleeve 52 are so arranged that their upper surfaces are substantially flush.

In FIG. 1, numeral 69 denotes a control panel incorporating a computer. The control panel 69 is for automatically cutting a laminate of sheet material in accordance with programmed data, as will be described below.

The operation for cutting a laminate of sheet material by the cutting apparatus of the present embodiment will now be described.

First, the air-impermeable sheet 17 is placed on the spreading table 16, the laminate 7 is formed by spreading sheets of a cloth material or the like on the air-impermeable sheet 17, and the air-impermeable sheet 18 is placed on the laminate 7 to cover the same. While this is being done, the ends of these sheets 17, 18 and laminate 7 are placed upon the laminate support portion 3a of the support belt 3. The belt drive motor 5 on the right side of FIG. 2 is brought into operation so that the support belt 3 is wound up on the take-up roller 4 situated on the right side of FIGS. 1 and 2. As a result, the laminate 7 whose upper and lower surfaces are covered by the air-impermeable sheets 18, 17 is moved to the right along with the support belt 3 and, as shown in FIGS. 1 through 3, is pulled onto the frame 1, after which the belt drive motor 5 is stopped. Under these conditions, the suction port members 21 are positionally adjusted in the transverse direction to conform to the width of the laminate 7, whereby the suction ports 21a of the suction port members 21 are made to approach both side faces of the laminate 7, with the leading end of the laminate 7 and the right ends of the suction port members 21 being in substantial agreement. Further, the air-impermeable sheets 17, 18 consisting of paper or the like cover the upper and lower surfaces as well as the right end face of the laminate 7 and are arranged to cover also opposing side edges of the suction port members 21 at both side edges. The suction apparatus is placed in operation to produce a suction from the suction ports 21a of the suction port members 21 via the suction duct 23, thereby depressurizing the interior of the laminate 7 so that mutually adjacent ones of the sheets forming the laminate are drawn into intimate contact with each other and so that the laminate is retained by the suction port members 21 while supported on the support portion 3*a* of the support belt 3.

Next, the travelling body 24 is made to travel in the longitudinal (X) direction, the cutter head 35 and cutter receiving sleeve 52 are moved in the transverse (Y) direction, and the cutter 40 and cutter receiving sleeve 52 are rotated about a vertical axis to cut the laminate 7.

More specifically, by rotating the motor 30 (FIG. 3) provided on the travelling body 24 in the forward and reverse directions, the gears 29 (FIG. 4) mounted on the travelling body 24 are rotated. Since these gears 29 mesh with the racks 25*a* of rack rails 25, the travelling body 24 travels in the longitudinal direction. In this case, the travelling body 24 is capable of travelling stably since it is embraced by the rack rails 25 at the gears 29 and front and rear wheels 28. As the travelling body 24 travels, the cutter head 35 provided with the cutter 40 and the lower receiving member 50 move longitudinally while opposing the laminate 7 from above and below. At this time the lower receiving member 50 is disposed within the movable recess 3*b* of the support belt 3. The movable recess 3*b* is formed by the four recess forming rollers 48, 49 freely rotatably supported on the side frames 26, 27 of the travelling body 24. Since the rollers 48, 49 move in unison with the lower receiving member 50 as the travelling body 24 travels, the support belt 3 and the lower receiving member 50 do not interfere with each other. When the movable recess 3*b* moves, the support plates 6 supporting the lower surface of the support potion 3*a* of support belt 3 forwardly of the travelling body 24 assume a lowerable state in response to release of the brake 14, which occurs when approach of the cam plates 66 secured to the travelling body 24 is sensed by suitable means due to travel of the travelling body. The rollers 67 attached to the support plates 6 then engage the cam grooves 66*a* of the cam plates 66 due to the travel of the traveling body 24, and the support plates 6 are urged under the movable recess 3*b*, while maintaining a horizontal attitude, as the travelling body 24 travels. As the travelling body 24 travels, the support plates 6 previously urged under the movable recess 3*b* rise as the rear of the recess 3*b* passes while being guided along by cam grooves 66*a*. When a support plate 6 separates from the cam plates 66, is assumes a state supporting the lower surface of the support portion 3*a* of support belt 3. By halting the brake releasing action, the brake 14 is locked in a raised position and the locked state is maintained. Accordingly, as the movable recess 3*b* moves, the supports plates 6 move downward in a successive fashion to avoid the movable recess 3*b* by means of the cam plates 66 as shown in FIG. 2. Thus, the lower surface of the support portion 3*a* of support belt 3 is supported at all times by the number of support plates 6 and the auxiliary support plate 68 secured to the travelling body 24.

By rotating the head and receiving portion drive motor 36 provided on the travelling body in the forward and reverse directions, the head drive pulley 37 and the receiving drive pulley 54 rotate in unison, so that the cutter head 35 and cutter receiving sleeve 52 are reciprocated transversely in the same direction in synchronism via the cutter head drive belt 39 and receiving portion connecting belt 56.

By rotating the cutter and receiving sleeve rotation motor 42 provided on the travelling body 24 in the forward and reverse directions, the upper spline shaft drive pulley 43 and lower spline shaft drive pulley 61 are driven in synchronism, so that the cutter 40 mounted on the cutter head 35 and the receiving sleeve 52 fitted into the closure plates 51 are rotated synchronousy in the same direction about a vertical axis via the upper spline shaft 45 and lower spline shaft 62.

Due to the longitudinal travel of the travelling body 24 and the transverse movement of the cutter head 35, the cutter 40 is brought to a prescribed position on the laminate 7. The cutter 40 is rotated in a prescribed direction and the motor (not shown) provided inside the cutter head 35 for raising and lowering the cutter is driven into operation to lower the cutter 40. When the cutter 40 is lowered, it penetrates the laminate 7 as well as the upper and lower air-impermeable sheets 18, 17, and the lower end of the cutter is received in the support hole 52*a* of the cutter receiving sleeve 52, whereby the upper and lower ends of the cutter 40 are supported. Owing to the combined longitudinal travel of the travelling body 24, the transverse movement of the cutter head 35 and the maneuvering produced by turning of the cutter 40, the laminate 7 is cut into the shape exemplified in FIG. 1 along with the upper and lower air-impermeable sheets 18, 17. The above-described cutting operation is performed automatically in accordance with data programmed by the control panel 69, whereby cut product is obtained.

The foregoing cutting operation is performed from the right side to the left side of the laminate 7 in FIG. 1. When cutting of the laminate 7 on the frame 1 ends, the cutter 40 is raised and the belt drive motor 5 is driven again to move the laminate 7 to the right so that the cutting operation may be repeated. When cutting along the entire length of the laminate 7 ends, the scraps are removed from the support belt 3 and the support belt 3 is rewound onto the take-up roller 4 on the left side.

In this embodiment of the invention, the upper end of the cutter 40 is held on the side of the cutter head 35 and, moreover, the lower end of the cutter 40 is supported by the cutter receiving sleeve 52 when cutting of the laminate 7 is performed. Thus, the cutter 40 is supported at both its upper and lower ends. As a result, the cutter 40 offers greater resistance at the time of cutting and flexes less in comparison with an arrangement in which solely the upper end of the cutter is supported. Furthermore, the laminate 7 is supported at the time of cutting, via the support portion 3*a* of support belt 3, by the large number of rising support plates 6 and the auxiliary support plates 68 secured to the travelling body 24. In addition, the lower receiving member 50, the closure plates 51 accommodated in the receiving member 50, and the cutter receiving sleeve 52 are arranged within the movable recess 3*b* of the support belt 3, and the upper surfaces of the lower receiving member 50, closure plates 51 and receiving sleeve 52 are situated on the same horizontal plane. This means that substantially the entire surface of the laminate 7 is supported on the same horizontal plane, so that a bulge will not form at the cut portion or in the vicinity thereof, thus enabling the laminate 7 to be cut in a state free of curves or bends in the vertical direction. Further, since the support plates 6, auxiliary support plates 68, receiving member 50, closure plates 51 and cutter receiving sleeve 52 are made of materials having a high rigidity, such as synthetic resins and/or metals, these will not bend or flex under the weight of the laminate 7. Since suction is applied to both side faces of the laminate 7 by the suction port members 21, mutually adjacent sheets of the laminate 7 are drawn into intimate contact with each other to reduce the overall thickness of the laminate in comparison with an arrangement in which suction is applied to the lower surface of the laminate. This makes it possible to cut all sheets of the laminate 7 in the thickness direction thereof very accurately.

In the present invention, it is permissible to use a modified support belt arrangement of the kind shown in FIG. 6. Here an endless support belt 3 is used, the belt 3 is supported by four support rollers 2, a drive roller 70 driven by the belt drive motor 5 is brought into pressured contact with the inner peripheral surface of the support belt 3 by a tension roller 71, and the support belt 3 is moved longitudinally by rotating the drive roller 70.

Figure 7:
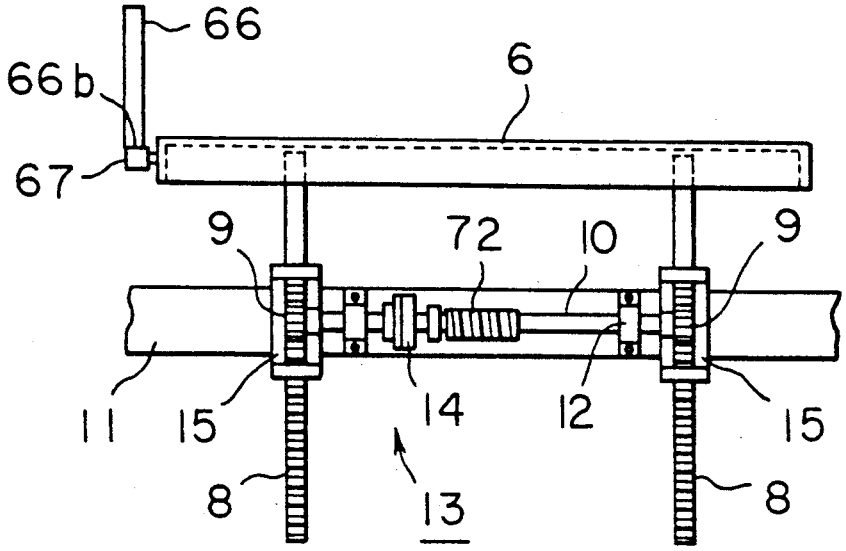
FIG. 7 is a front view of a modification of a mechanism for raising and lowering support plates.
Figure 8:
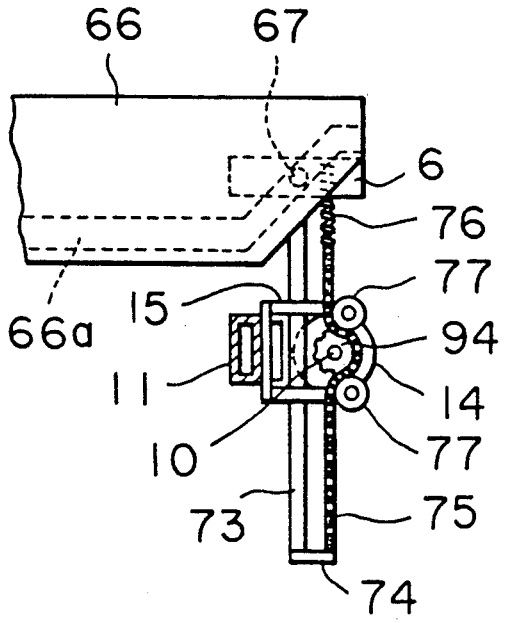
FIG. 8 is a side view illustrating another modification of the mechanism for raising and lowering support plates.
Figure 9:
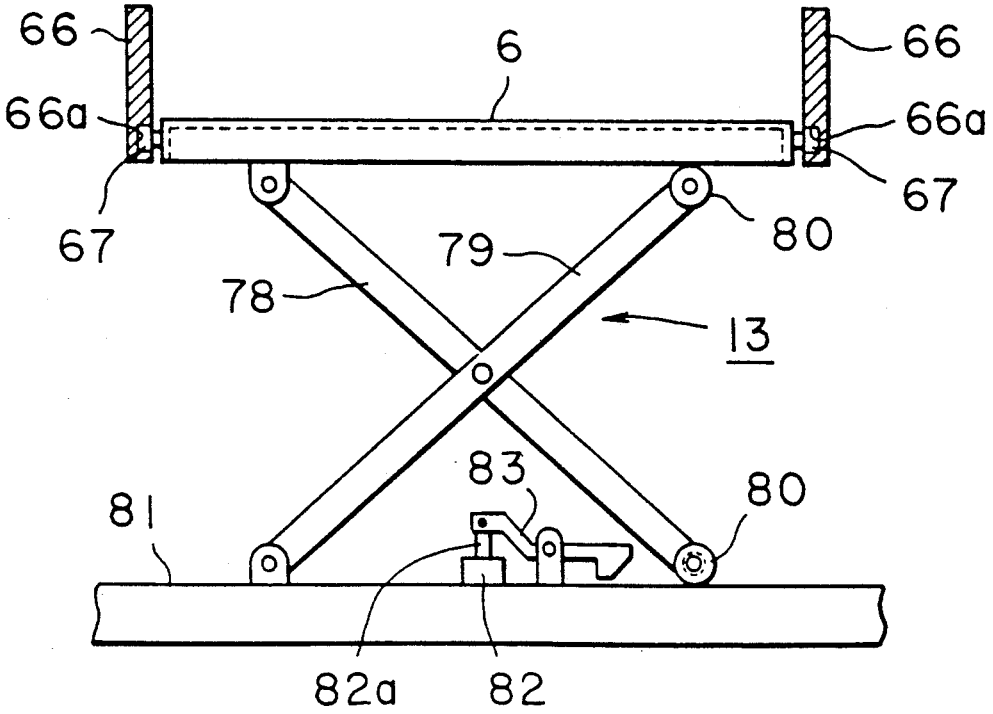
FIG. 9 is a front view still another modification of the mechanism for raising and lowering support plates.

In accordance with the invention, the mechanism 13 for raising and lowering the support plates 6 can be modified as shown in FIGS. 7, 8 and 9.

In the modification of FIG. 7, the lower side face of cam plate 66 is formed to have a shape similar to that of the cam groove 66*a* of FIG. 4, the cam roller 67 mounted on the support plate 6 is brought into pressured contact with the cam face 66*b*, and the connecting shaft 10 is connected to a support plate retaining member 11 by a torsion spring 72 for biasing the support plate 6 upwardly at all times in such a manner that the lower surface of the support portion of the support belt is supported by the support plate 6. In this modification, the cam plate 66 and the cam roller 67 can be provided solely on one side in the transverse direction. However, it is permissible to provide these on both sides if desired.

In the modification of FIG. 8, the upper ends of a pair ob left and right guide rods 73 are secured to the lower surface of the support plate 6. A chain 75 is connected to lower ends of these guide rods via mounting pieces 74. The upper end of the chain 75 is connected to the lower surface of the support plate 6 via a tension spring 76 and the chain 75 is meshed with a sprocket 94. The chain 75 is prevented from falling off the sprocket 94 by upper and lower rollers 77 rotatably attached to the support plate retaining member 11, and the brake 14 is attached to the connecting shaft 10. The support plate 6 is held at the elevated position by the brake 14, just as in the arrangement of FIG. 3.

In the modification of FIG. 9, the raising and lowering mechanism 13 has a cross-bar configuration in which the upper end of one arm 78 is pivotally attached to the bottom of the support plate 6, the mid-point of the arm 78 is pivotally attached to the mid-point of another arm 79, a roller 80 mounted on the lower end of the arm 78 is supported on the upper surface of a mounting member 81 secured to the frame, the lower end of the arm 79 is pivotally supported on the mounting member 81, and a roller 80 mounted on the upper end of the arm 79 is supported on the lower surface of the support plate 6. A solenoid mechanism 82 is provided on the mounting member 81, one end of a hook 83 rockably mounted on the mounting member 81 via a bracket is pivotally attached to a plunger 82*a* of the mechanism 82, and the other end of the hook 83 is engaged with the roller 80 of the arm 79 in a state elevated above the support plate 6. When the support plate 6 is lowered, the hook 83 is disengaged from the roller 80 by actuation of the solenoid mechanism 82.

Figure 10:
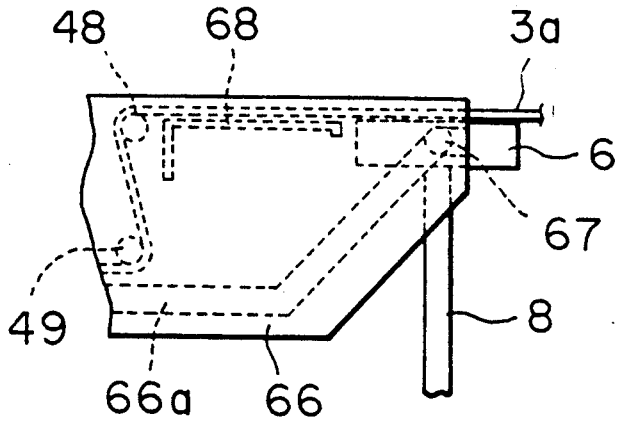
FIGS. 10 and 11 are side views illustrating different modifications of auxiliary supports.
Figure 11:
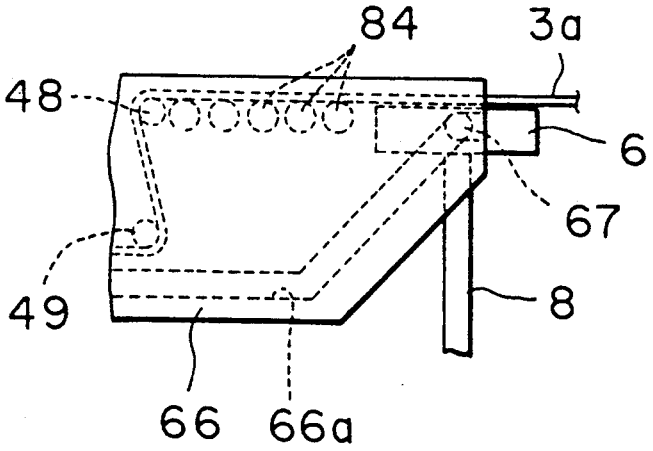

As shown in FIG. 10, the invention can be so arranged that the auxiliary support plate 68 is provided on the side of the recess forming roller 48, which is higher than the end of the cam plate 66. It is also possible to adopt the arrangement shown in FIG. 11, in which, rather than using the auxiliary support plates, a plurality of auxiliary support rollers 84 extending in the transverse (Y) direction and spaced apart a small distance in the longitudinal (X) direction are rollably supported on the left and right cam plates 66 (or frame members). The auxilary support plate 68 and auxiliary support rollers 84 can be deleted if the lengths of the cam plates 66 projecting in the longitudinal direction from the movable recess 3*b* are small.

It should be noted that portions in FIGS. 6 through 11 corresponding to those shown in FIGS. 1 through 5 are designated by like reference characters, and that parts of the structure other than those described above are identical with those shown in FIG. 1 through 5.

Figure 12:
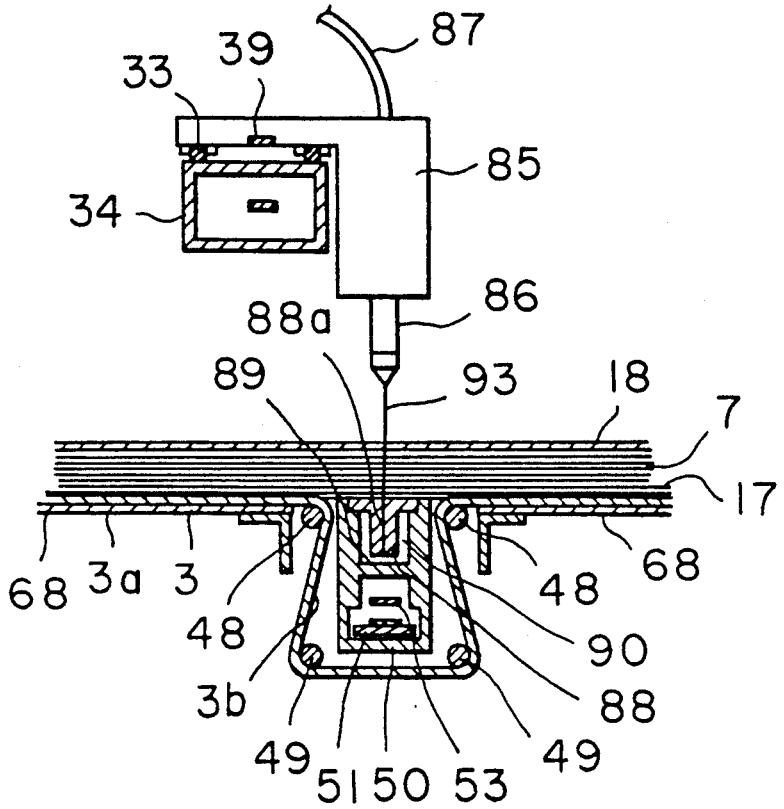
FIGS. 12 and 13 are a longitudinal sectional view and transverse sectional view, respectively, of a nozzle head and liquid receiving sleeve and illustrate another embodiment of a a laminated sheet material cutting apparatus according to the present invention.
Figure 13:
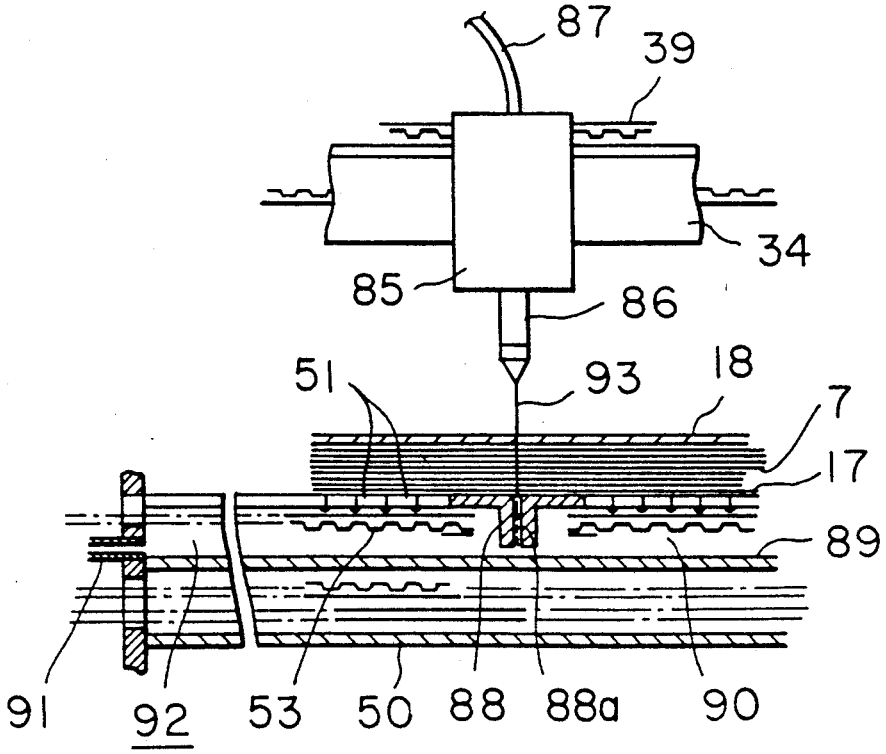

FIGS. 12 and 13 illustrate a nozzle head head receiving portion according to another embodiment of the present invention. In accordance with this embodiment, a nozzle head 85 which reciprocates in the transverse (Y) direction is supported on the connecting beam 34 of the travelling body, and a nozzle 86 for jetting a superhigh pressure liquid is mounted on the nozzle head 85 so as to be capable of being raised and lowered. A liquid feed hose 87 connected to the nozzle 86 is connected with a device (not shown) for feeding the superhigh pressure liquid. Secured beneath the nozzle head 85 is a lower receiving member 50 fixed to the travelling body, the closure plates 51 of the receiving portion drive belt 53 are accommodated in the lower receiving member 50, and a liquid receiving sleeve 88 directly below the nozzle 86 and opposing the same is fitted between the closure plates 51. The liquid receiving sleeve 88 is formed to have a bore 88*a* passing vertically therethrough, and a liquid passageway 90 is formed above a partitioning plate 89 provided in the lower receiving 50. The liquid passageway 90 is open at the lower end of the bore 88*a*. The liquid passageway 90 is closed by the frame members of the travelling body and is connected to a liquid recovery pipe 91 which passes through one of the frame members 27. Thus is constructed a liquid discharge passageway 92. The liquid recovery pipe 91 is connected to a liquid reservoir (not shown) provided on the travelling body. In this embodiment, the laminate support portion 3*a* of the support belt 3, the lower receiving member 50, the closure plates 51 and the liquid receiving sleeve 88 are so arranged that their upper surfaces lie on the same horizontal plane. Structural features other than those described in this embodiment are substantially the same as in the first embodiment provided that the cutter and the cutter receiving portion of the first embodiment shown in FIGS. 1 through 5 are substituted by the nozzle and nozzle receiving portion. Since superhigh pressure liquid 93 such as water jetted from the nozzle 86 forms a linear stream, there is no need for mechanisms for rotating the nozzle 86 and liquid receiving sleeve 88 about a vertical axis, and these mechanisms are not provided. Portions in FIGS. 12 and 13 similar to those in FIGS. 1 through 5 are designated by like reference characters.

In the embodiment of FIGS. 12 and 13, the travelling body is made to travel in the longitudinal (X) direction, and the nozzle 86 provided on the nozzle head 85 and the liquid receiving sleeve 88 are moved synchronously in the transverse (Y) direction, this being similar to the operation in the embodiment of FIGS. 1 through 5. During this operation, the superhigh pressure liquid 93 is jetted straight down from the nozzle 86, whereby the liquid penetrates and cuts through the laminate 7 and air-impermeable sheets 17, 18 supported on the support portion 3*a* of the support belt. The liquid 93 passes through the bore 88*a* in the liquid receiving sleeve 88 and is guided into the liquid reservoir from the liquid discharge passageway 92. The nozzle 86 in this embodiment is raised or lowered in dependence upon the thickness of the laminate 7. The liquid discharge passageway 92 may be so adapted that the liquid is recovered externally of the apparatus by a flexible hose.

In accordance with the present invention, driving force is transmitted from motors using timing belts. However, an arrangement can be adopted in which ball screws and chains are employed instead. In another possible arrangement, an arranging table can be connected to the frame on the side thereof opposite the spreading table. This will make it possible to separate the cut articles from the scraps on the arranging table.

The present invention has a number of advantages. Specifically, in accordance with the invention, the longitudinally extending suction port members are arranged on the frame along both sides thereof, a number of the lowerable support plates are held by the frame in side-by-side relation in the longitudinal direction, and the portion of the support belt which supports the laminated sheet material is supported on the support plates, whereby the laminated sheet material, the upper and lower surfaces whereof are covered with the air-impermeable sheet, is supported on the support portion of the belt. When suction is applied to the two side surfaces of the laminate by the suction port members, mutually adjacent sheets of the laminate are drawn into intimate contact with each other so that the overall thickness of the laminate can be reduced in comparison with an arrangement in which suction is applied to the lower surface of the laminate. The upper end portion of the cutter is mounted on the cutter head, the lower end portion of the cutter is supported by the cutter receiving sleeve, and the upper surfaces of the receiving sleeve, the closure plates between which the sleeve is inserted, and the lower receiving member are arranged on a horizontal plane substantially level with the support surface of the support belt. As a result, the laminate will not buckle or bulge vertically at the portion thereof cut by the cutter. Accordingly, even a thick laminate of sheet material can be cut very accurately.

Further, in accordance with the invention, the linear stream of the superhigh pressure liquid jetted by the nozzle makes it possible to cut the laminate while the entire laminate is in the state of reduced thickness and substantially free of curvature in the vertical direction, achieved by the means described above. By virtue of the fact that the superhigh pressure liquid jetted from the nozzle is non-directional, there is need for mechanisms for turning the nozzle and the immediately underlying receiving sleeve synchronously about a vertical axis. As a result, cutting having a precision as high as that of the arrangement using the cutter can be achieved through a comparatively simple construction.

As many apparently widely different embodiments of the present invention can be made without departing from the spirit and scope thereof, it is to be understood that the invention is not limited to the specific embodiments thereof except as defined in the appended claims.

What is claimed is:

1. An apparatus for cutting sheet material, said apparatus comprising:

a frame;

a movable planar support member having a planar support surface for supporting the sheet material to be cut;

means for moving said support member relative to said frame;

a body disposed above said support surface;

a cutting element disposed on said body;

means defining a moveable recess in said planar support surface, said movable recess being moveable in said moveable planar support surface and with respect to said frame and further being sized to receive a portion of said cutting element, said body including means to reciprocate said cutting element in said recess;

a plurality of support plates, individually movable reciprocally on said frame normal to said movable support surface, said support plates being moveable into a support relationship with said moveable planar support surface and out of said support relationship to permit said means defining a moveable recess to move relative to said frame; and means for synchronously moving said cutting element and said recess in multiple directions in the plane of said planar surface.

2. The apparatus of claim 1 wherein said means defining a moveable recess is elongated and includes a plate disposed in said generally U-shaped trough, said plate having an opening therein for receiving said cutting element and being moveable in said trough along a major axis thereof.

3. The apparatus of claim 1, wherein said moveable planar support surface comprises a moveable belt.

4. The apparatus of claim 1, further including means for moving said means defining a moveable recess relative to said frame and for synchronously moving said support plates into and out of said support relationship with the movement of said means defining a moveable recess.

5. The apparatus of claim 1, further comprising camming means for reciprocally moving said plurality of support plates individually into and out of said supporting relationship.

6. The apparatus of claim 5, wherein said camming means comprises:

a cam element on each of said support plates; and means defining a cam groove fixed relative to said frame, said cam element being received in and following said groove.

* * * * *